US008650679B1

(12) United States Patent
Clark et al.

(10) Patent No.: US 8,650,679 B1
(45) Date of Patent: Feb. 18, 2014

(54) DYNAMIC HAMMOCK SPREADER APPARATUS

(71) Applicant: Clark Outdoor Products, L.C., Salt Lake City, UT (US)

(72) Inventors: Gary L. Clark, Salt Lake City, UT (US); Spencer D. Clark, Salt Lake City, UT (US)

(73) Assignee: Clark Outdoor Products, L.C., Salt Lake City, UT (US)

( * ) Notice: Subject to any disclaimer, the term of this patent is extended or adjusted under 35 U.S.C. 154(b) by 0 days.

(21) Appl. No.: 13/743,788

(22) Filed: Jan. 17, 2013

Related U.S. Application Data

(63) Continuation of application No. 12/574,166, filed on Oct. 6, 2009, now Pat. No. 8,356,370.

(51) Int. Cl.
*A45F 3/22* (2006.01)
*A45F 4/08* (2006.01)
*A45F 3/24* (2006.01)

(52) U.S. Cl.
USPC ..... 5/123; 5/120; 5/121; 5/128; 135/90; 135/95

(58) Field of Classification Search
USPC ..... 5/120–122, 123, 128; 135/90, 95, 135/124–128, 136, 138
See application file for complete search history.

(56) References Cited

U.S. PATENT DOCUMENTS 329,690 A 11/1885 Thomas
329,763 A 11/1885 Nelmes
495,366 A 4/1893 Perry
631,747 A 8/1899 Lloyd
955,281 A 4/1910 Norwood
1,401,846 A 12/1921 Wiles
2,827,949 A 3/1958 Kershaw
3,970,096 A 7/1976 Nicolai
4,001,902 A 1/1977 Hall et al.
4,021,868 A 5/1977 Fueslein
4,057,859 A 11/1977 Setterholm
4,320,542 A 3/1982 Cohen
4,686,720 A 8/1987 Newell
6,347,638 B1 2/2002 Scott et al.
7,383,597 B2 6/2008 Steiner
8,161,991 B2 4/2012 Johnson
8,356,370 B1 1/2013 Clark et al.
2005/0188460 A1 9/2005 O'Brien
2009/0065036 A1 3/2009 Johnson

OTHER PUBLICATIONS

The Blue Ridge Camping Hammock, www.lawsonhammock.com, pp. 1 and 2.
Lawson Blue Ridge Camping Hammock www.backpacker.com/gear/12462, Jun. 2008.

*Primary Examiner* — Michael Trettel
(74) *Attorney, Agent, or Firm* — Warren M. Pate; Pate Peterson, PLLC

(57) ABSTRACT

A method for spreading a hammock is disclosed. The method may include selecting a hammock comprising a hammock base having a first end, a second end opposite the first end in a longitudinal direction, a first side, and a second side opposite the first side in a lateral direction. The method may further include suspending the first end of the hammock base from a first anchor and suspending the second end of the hammock base from a second anchor. Once suspended, the hammock base may be spread in the lateral direction using exclusively a dynamic spreader system. The dynamic spreader system may automatically adjust the amount of the spreading in response to changes in the weight, shape, or orientation of contents within the hammock base.

20 Claims, 7 Drawing Sheets

DYNAMIC HAMMOCK SPREADER APPARATUS

RELATED APPLICATIONS

This application is a continuation of U.S. patent application Ser. No. 12/574,166 filed Oct. 6, 2009 and now U.S. Pat. No. 8,356,370, which is hereby incorporated by reference.

BACKGROUND

1. The Field of the Invention

This invention relates to hammocks and, more particularly, to novel systems and methods for a dynamic hammock spreader providing the advantages of a rigid spreader without the instability associated therewith.

2. The Background Art

A hammock can typically be classified as one of two types or varieties. The first type of hammock is a hammock with one or more spreaders. The second type of hammock is a spreaderless hammock. Both types of hammocks have their strong points and weaknesses. For example, a hammock with a spreader is typically open, inviting, and non-confining. However, that hammock will typically be unstable. That is, if an occupant does not properly position himself over the center of the hammock, the hammock will roll, dumping the occupant on the ground.

Conversely, while spreaderless hammocks are quite stable, they have other problems. For example, without additional, external tethers, the material of a spreaderless hammock will tend to collect around an occupant. Many occupants find this cocooning effect to be undesirable.

In view of the foregoing, what is needed is a hammock providing the benefits of both spreader and spreaderless hammocks, without the liabilities and problems of either.

BRIEF SUMMARY OF THE INVENTION

In view of the foregoing, in accordance with the invention as embodied and broadly described herein, a method and apparatus are disclosed in one embodiment of the present invention as including a hammock comprising a hammock base and a hammock canopy. A hammock base may support the weight of a user occupying the hammock. A hammock canopy may extend over a hammock base and cooperate therewith in forming an enclosure. In certain embodiments, corresponding ends of the hammock base and hammock canopy may be gathered by first and second tethers. Accordingly, a hammock may converge to the respective tethers at each end.

Without any spreader, a hammock may tend to bunch together in the lateral direction. Such bunching may make it more difficult to enter a hammock. Thus, in selected embodiments, a hammock in accordance with the present invention may include a spreader system. In certain embodiments, a spreader system may be dynamic, varying or balancing the amount of spreading in the lateral direction imposed on the hammock.

Through the use of a dynamic spreader system, a hammock in accordance with the present invention may provide certain advantages associated with hammocks having rigid spreaders. However, due the dynamic nature of such a spreader system, a hammock in accordance with the present invention may avoid the instability associated with hammocks having rigid spreaders.

In selected embodiments, a dynamic spreader system may comprise one or more springs urging separation of the first and second sides of the hammock base. For example, in one embodiment, a dynamic spreader system may comprise one or more spreaders resiliently deflected to urge the first side of a hammock base away from the second side of the hammock base.

In certain embodiments, a spreader may comprise a flexible rod. A flexible rod may have a substantially linear neutral or non-deflected configuration. When resiliently bent, a flexible rod may arch over or under a hammock base. The ends of the flexible rod may be connected to respective sides of the hammock base. Accordingly, the tendency of the flexible rod to return to its substantially linear neutral configuration may urge the first side of the hammock base away from the second side of the hammock base. The flexible rod may be sized (e.g., in length, thickness, and the like) or configured such that the magnitude of this urging is insufficient to impart to the hammock base the instability associated with hammocks having rigid spreaders.

In embodiments where a spreader arches over a hammock base, the spreader may space a hammock canopy from a hammock base, increasing the volume of the enclosure therebetween. Loops, sleeves, hooks, or the like may be used to connect a spreader to a hammock canopy. The arch of the spreader may define or control the arch of the hammock canopy over the hammock base.

A dynamic spreader system in accordance with the present invention may automatically adjust the amount of spreading imposed on a hammock. In selected embodiments, this adjusting may be in response to changes in the weight, shape, orientation, and the like, or combinations thereof, of contents within the hammock base. Moreover, this adjusting may reflect or accommodate a new equilibrium between the forces generated by a dynamic spreader system and the forces associated with a hammock.

That is, a dynamic spreader system may increase the separation between the first and second sides of a hammock base until an equilibrium is reached between the forces generated by the dynamic spreader system and opposing forces associated with the weight of the hammock, its contents, etc. As the forces associated with the weight of the hammock, its contents, etc. change, the position of a dynamic spreader system at equilibrium therewith may vary.

In selected embodiments, a dynamic spreading system may be configured to provide (e.g., have a length and effective spring constant selected to provide) an optimal equilibrium when the corresponding hammock is occupied by a user. For example, a spreader may have a length and resiliency in bending such that the height of the arch formed by the spreader when the hammock base is occupied provides an optimal suspension and tensioning of the hammock canopy. This optimal suspension and tensioning may be characterized by a lack of unwanted sagging and a lack of excessive tension in the hammock canopy.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
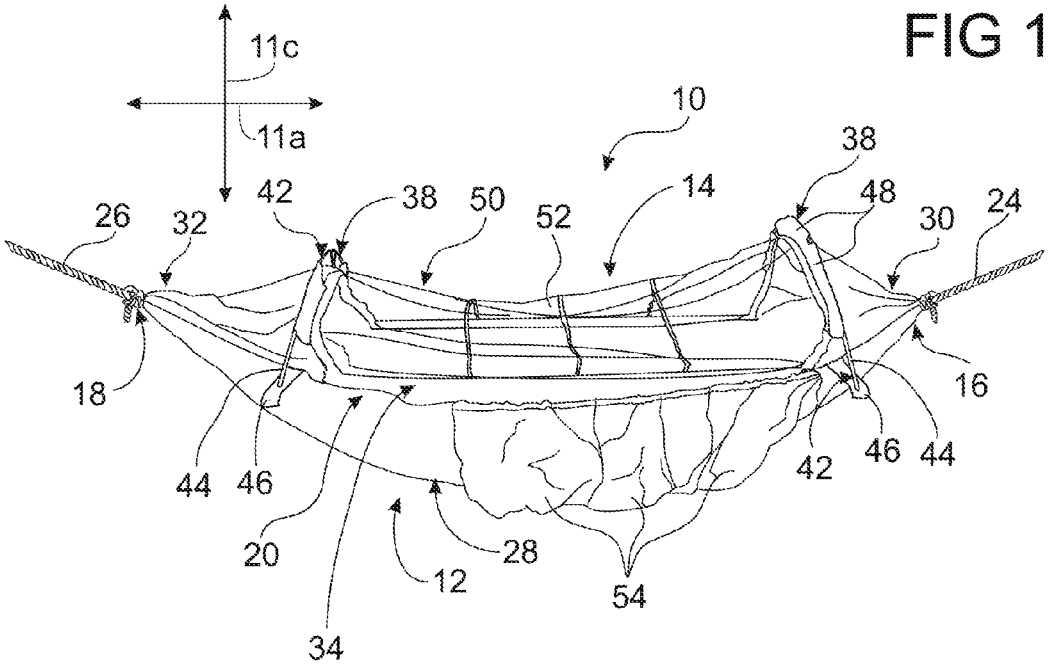
FIG. 1 is a side perspective view of a hammock in accordance with the present invention in an unoccupied configuration and substantially unweighted by contents.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1 through 4, in discussing a hammock 10 in accordance with the present invention, it may be advantageous to establish a reliable coordinate system. Accordingly, a coordinate axes may be defined comprising longitudinal 11*a*, lateral 11*b*, and transverse directions 11*c* substantially orthogonal to one another.

A hammock 10 in accordance with the present invention may include a hammock base 12 and a hammock canopy 14. A hammock base 12 may support the weight of a user occupying the hammock 10. A hammock canopy 14 may extend over a hammock base 12 and cooperate with the hammock base 12 in forming an enclosure. This enclosure may protect a user occupying the hammock 10 from insects, wind, rain, etc.

In selected embodiments, a hammock base 12 may be formed of flexible material such as a flexible fabric. A hammock base 12 may have a first end 16, a second end 18 opposite the first end 16 in the longitudinal direction 11*a*, a first side 20, and a second side 22 opposite the first side 20 in the lateral direction 11*b*. The material forming a hammock base 12 may have any suitable shape. In certain embodiments, the material forming a hammock base 12 may have a generally rectangular shape.

The first end 16 of a hammock base 12 may be folded to form a sleeve as disclosed in U.S. Pat. No. 5,913,772, which is hereby incorporated by reference. Such a sleeve may be constructed to receive a first tether 24 (e.g., rope 24, strap 24, or the like) therethrough. The second end 18 of a hammock base 12 may be folded in like manner. Accordingly, the second end 18 may receive a second tether 26 (e.g., rope 26, strap 26, or the like) therethrough. The first and second ends 16, 18 may be respectively gathered and secured by the first and second tethers 24, 26. The first and second tethers 24, 26 may then extend from the hammock 10 to engage, or be suspended from, corresponding anchors (e,g., trees, posts, beams, hooks, etc.).

With each end 16, 18 pulled into a gather, the hammock base 12 may form a concavity. That is, gathering the first and second ends 16, 18 may cause the sides 20, 22 of the hammock base 12 to be pulled upwards in the transverse direction 11*c*, leaving a center portion 28 of the hammock base 12 to sag with slack therebetween and below. This concavity may form a comfortable, stable, and supportive space for a user to occupy.

A hammock canopy 14 in accordance with the present invention may be formed of flexible material such as a flexible fabric. Like a hammock base 12, a hammock canopy may have a first end 30, a second end 32 opposite the first end 30 in the longitudinal direction 11*a*, a first side 34, and a second side 36 opposite the first side 34 in the lateral direction 11*b*. The material forming a hammock canopy 14 may have any suitable shape. In certain embodiments, the material forming a hammock canopy 14 may have a generally rectangular shape.

The first and second ends 30, 32 and first and second sides 34, 36 of a hammock canopy 14 may be respectively secured (e.g., sewn) to the first and second ends 16, 18 and first and second sides 20, 22 of a hammock base 12. In selected embodiments, the first end 30 of a hammock canopy 12 may be secured to the first end 16 of a hammock base 12 as disclosed in U.S. Pat. No. 5,913,772. The second end 34 of a hammock canopy 14 may be secured to the second end 18 of the hammock base 12 in like manner.

In certain embodiments, due to their respective securement to the first and second ends 16, 18, the first and second ends 30, 32 of the hammock canopy 14 may be gathered by the first and second tethers 24, 26. Accordingly, a hammock 10 may converge to the respective tethers 24, 26 at each end. Moreover, without any spreader, a hammock 10 may tend to bunch together in the lateral direction 11*b*. Such bunching may make it more difficult to enter a hammock 10. Thus, in selected embodiments, a hammock 10 in accordance with the present invention may include a spreader system 38.

In selected embodiments, a spreader system 38 may be dynamic, varying or balancing the amount of spreading 40 in the lateral direction 11*b* imposed on the hammock 10. In such embodiments, the spreading 40 of a hammock 10 in the lateral direction 11*b* may be accomplished using exclusively a dynamic spreader system 38.

Through the use of a dynamic spreader system 38, a hammock 10 in accordance with the present invention may provide certain advantages associated with hammocks having rigid spreaders. However, due the dynamic nature of such a spreader system 38, a hammock 10 in accordance with the present invention may avoid the instability associated with hammocks having rigid spreaders.

A dynamic spreader system 38 in accordance with the present invention may take any suitable form. In selected embodiments, a dynamic spreader system 38 may comprise one or more springs urging separation of the first and second sides 20, 22 of the hammock base 12. For example, in one embodiment, a dynamic spreader system 38 may comprise one or more spreaders 42 resiliently deflected to urge the first side 20 of a hammock base 12 away from the second side 22 of the hammock base 12.

In selected embodiments, a spreader 42 may comprise a flexible rod 44. A flexible rod 44 may have a substantially linear neutral or non-deflected configuration. When resiliently bent, a flexible rod 44 may arch over or under a hammock base 12. The ends of the flexible rod 44 may be connected to respective sides 20, 22 of the hammock base 12. The tendency of the flexible rod 44 to return to its substantially linear neutral configuration may urge the first side 20 of the hammock base 12 away from the second side 22 of the hammock base 12. The flexible rod 44 may be sized or configured such that the magnitude of this urging is insufficient to impart to the hammock base 12 the instability associated with hammocks having rigid spreaders.

A flexible rod 44 in accordance with the present invention may be formed of any suitable material or materials and have any suitable configuration. In selected embodiments, a flexible rod 44 may comprise multiple rod segments connected via one or more couplers. By removing certain of such rod segments from corresponding couplers, each flexible rod 44 may be broken down for easier transport and storage. In one embodiment, solid, cylindrical, fiber glass rods of about one eighth inch (0.3 cm) to about quarter inch diameter (0.6 cm) may be suitable rod segments.

A spreader 42 in accordance with the present invention may be connected to a hammock 10 in any suitable manner. In selected embodiments, an extension strap 46 may extending from each side of a hammock 10 to engage respective ends of a spreader 42. Such extension straps 46 may secure to a hammock 10 in any suitable manner. For example, they may be sewn to the sides 20, 22 of the hammock base 10 or the sides 34, 36 of the hammock canopy 14. In one embodiment, extension straps 46 may be sewn into a seam joining a hammock base 12 to a hammock canopy 14.

Similarly, a spreader 42 in accordance with the present invention may be connected to an extension strap 46 in any suitable manner. In selected embodiments, an extension strap 46 may have a pocket formed therein. This pocket may receive and secure the end of a spreader 42 inserted therewithin. In other embodiments, an extension strap 46 may include a grommet. In such embodiments, an end of a spreader 42 may be configured to engage the grommet.

In embodiments where a spreader 42 arches over a hammock base 12, the spreader 42 may space a hammock canopy 14 from a hammock base 12, increasing the volume of the enclosure therebetween. In such embodiments, a spreader 42 may extend internally or externally with respect to a hammock canopy 14. Loops, sleeves 48, hooks, or the like may be used to connect a spreader 42 to a hammock canopy 42. For example, in one embodiment, one or more sleeves 48 may be secured to, or formed as part of, the hammock canopy 14. A spreader 42 may extend externally with respect to a hammock canopy 14, passing through the sleeves 48. The arch of the spreader 42 may define or control the arch of the hammock canopy 14 over the hammock base 12.

In selected embodiments, a spreader system 38 may include one or more spreaders 42. In one embodiment, a spreader system 38 may have only one spreader 42 positioned proximate the "head end" of a hammock base 12. In other embodiments, a spreader system 38 may have two spreaders 42. For example, one spreader 42 may be located proximate a first end 16 of a hammock base 12, while the other 42 may be positioned proximate a second end 18 of the hammock base 12. In such embodiments, a hammock 10 may have a generally cylindrical mid-section with conical ends gathered to converge to respective tethers 24, 26.

In certain embodiments, a hammock canopy 14 may have a door 50 or entryway 50 formed therein. For example, a hammock canopy 14 may include a portion of material 50 that is connected, at least partially, to the rest of the hammock canopy 14 via a zipper. By operating the zipper, a user may create an opening into the enclosure formed by the hammock base 12 and hammock canopy 14.

An entryway 50 in a hammock canopy 14 may have multiple layers. For example, an entryway 50 may include a screen or mesh layer 52 providing both ventilation and a barrier to insects. An entryway 50 may also include a wind break layer resisting air flow through the entryway 50 Accordingly, when the wind break layer is closed (e.g., zipped closed), an occupant of the hammock 10 may be protected from excessive exchange with the outside air. Such a configuration may be desirable in windy or cold conditions.

The perimeter of an entryway 50 in accordance with the present invention may have any suitable shape or configuration. In one embodiment having two spreaders 42, the perimeter (e.g., zipper) of an entryway 50 may encircle or encompass substantially the entire portion of the hammock canopy 14 between the first and second sides 34, 36 and the two spreaders 42.

In selected embodiments, a hammock 10 may include storage pockets 54. The preferably large pockets 54 may be placed underneath the hammock base 12. The pockets 54 may provide space for storing gear, food, and supplies off the ground and within easy reach of an occupant of the hammock 10. The pockets 52 may also provide a dead air space on the underside of the hammock base 12. The dead air space may slow heat flow from the occupant out through the underside of the hammock base 12. In other embodiments, the pockets 52 may be omitted or under-quilting may be substituted in the place of the pocket 52.

A dynamic spreader system 38 in accordance with the present invention may automatically adjust the amount of spreading 40 imposed on a hammock 10. In selected embodiments, this adjusting may be in response to changes in the weight, shape, orientation, and the like, or combinations thereof, of contents within the hammock base 12. Moreover, this adjusting may reflect or accommodate a new equilibrium between the forces generated by a dynamic spreader system 38 and the forces associated with a hammock 10.

That is, a dynamic spreader system 38 may urge separation of the first and second sides 20, 22 of a hammock base 12. However, this separation may not occur in isolation. Movement of the first and second sides 20, 22 of a hammock base 12 away from each other in the lateral direction 11*b* may induce other, corresponding movements.

For example, lateral separation may draw the center portion 28 of the hammock base 12 upward in the transverse direction 11*c*. Additionally, lateral separation may draw the first and second ends 16, 18 of the hammock base 12 closer together in the longitudinal direction 11*a*. This latter motion may reduce the slack with which the hammock 10 hangs between corresponding anchors and effectively raise the elevation of the entire hammock 10.

Accordingly, a dynamic spreader system 38 may increase the separation between the first and second sides 20, 22 of a hammock base 12 until an equilibrium is reached between the forces generated by the dynamic spreader system 38 and opposing forces associated with the weight of the hammock 10, its contents, etc. As the forces associated with the weight of the hammock 10, its contents, etc. change, the position of a dynamic spreader system 38 at equilibrium therewith may vary.

For example, in an empty or lightly weighted hammock 10 (e.g., the hammock of FIGS. 1 and 2), there may be little weight urging the central portion 28 of a hammock base 10 downward. In such situations, the forces opposing a dynamic spreading system 38 may be at a minimum. Accordingly, the amount of spreading 40 imposed by the dynamic spreading system 38 may be at a maximum.

Conversely, in a loaded or occupied hammock 10 (e.g., the hammock of FIGS. 3 and 4), there may be significant weight urging the central portion 28 of a hammock base 10 downward. In such situations, the forces opposing a dynamic spreading system 38 may be substantial. Accordingly, the amount of spreading 40 imposed by the dynamic spreading system 38 may be reduced.

Shape, orientation, and the like of contents within a hammock 10 may also influence the amount of spreading 40 imposed by the dynamic spreading system 38. For example, an object may have a length greater than its width. When the object is placed within a hammock base 12 such that the length of the object aligns with the longitudinal direction 11*a*, a first equilibrium may be reached between the forces associated with the object and those of the dynamic spreader system 38. When the object is placed within a hammock base 12 such that the length of the object aligns with the lateral direction 11*b*, a second equilibrium may be reached between the forces associated with the object and those of the dynamic spreader system 38. In such an example, the object weighs the same in both orientations. However, the spreading 40 associated with the second equilibrium may be greater than the spreading 40 associated with the first equilibrium.

In selected embodiments, a dynamic spreading system 38 in accordance with the present invention may be configured to provide (e.g., have a length and effective spring constant selected to provide) an optimal equilibrium when the corresponding hammock 10 is occupied by a user. That is, like a tent, a hammock 10 in accordance with the present invention may appear to its greatest advantage when it is pitched or set up tightly with a minimum of sagging material. Accordingly, the amount of spreading 40 provided by, and the overall configuration of, a dynamic spreader system 38 at equilibrium with an occupied hammock 10 may coincide with and support an optimally deployed configuration of the occupied hammock 10.

For example, in selected embodiments, a dynamic spreader system 38 may comprise a spreader 42 arching over a hammock base 12. In such embodiments, changes in the amount of spreading 40 may correspond to changes in the grade (i.e., degree of incline) and overall height of the arch formed by the spreader 42. In general, the greater the amount of spreading 40, the less the grade and the overall height of the arch and vice versa.

In certain embodiments, changes in the overall height of an arch formed by a spreader 42 may affect a hammock canopy 14 supported by the spreader 42. For example, the height of an arch may affect the amount of separation between a hammock canopy 12 and a hammock base 14. The height on an arch may also affect the amount of sag within a hammock canopy 14. Too little height my cause the hammock canopy 14 to sag excessively, causing unwanted encroachment into the space of an occupant of the hammock base 12. Too much height may cause a hammock canopy 14 to be pulled excessively tight, causing unwanted wear on seams, zippers of an entryway 50, etc.

Accordingly, in selected embodiments, a spreader 42 may have a length and resiliency in bending such that the height of the arch formed by the spreader 42 when the hammock base 12 is occupied provides an optimal suspension and tensioning of the hammock canopy 14. This optimal suspension and tensioning may be characterized by a lack of unwanted sagging and a lack of excessive tension in the hammock canopy 14.

Due to the dynamic nature of the spreading 40 imposed by a dynamic spreader system 38 in accordance with the present invention, a spreader 42 optimized for an occupied hammock base 12 may not be optimized for that hammock 10 when the hammock base 12 is unoccupied and substantially unweighted. However, it has been found that the shape or configuration of such a hammock 10 when unoccupied and substantially unweighted is suitable for its intended purpose.

Figure 2:
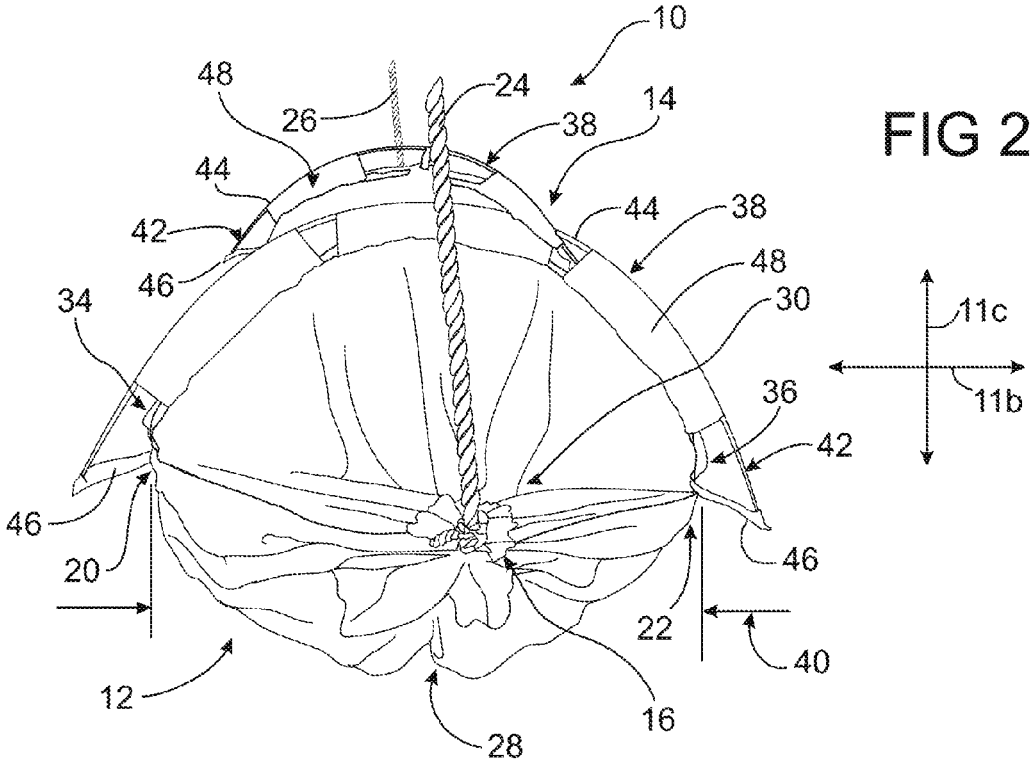
FIG. 2 is an end perspective view of the hammock of FIG. 1.
Figure 3:
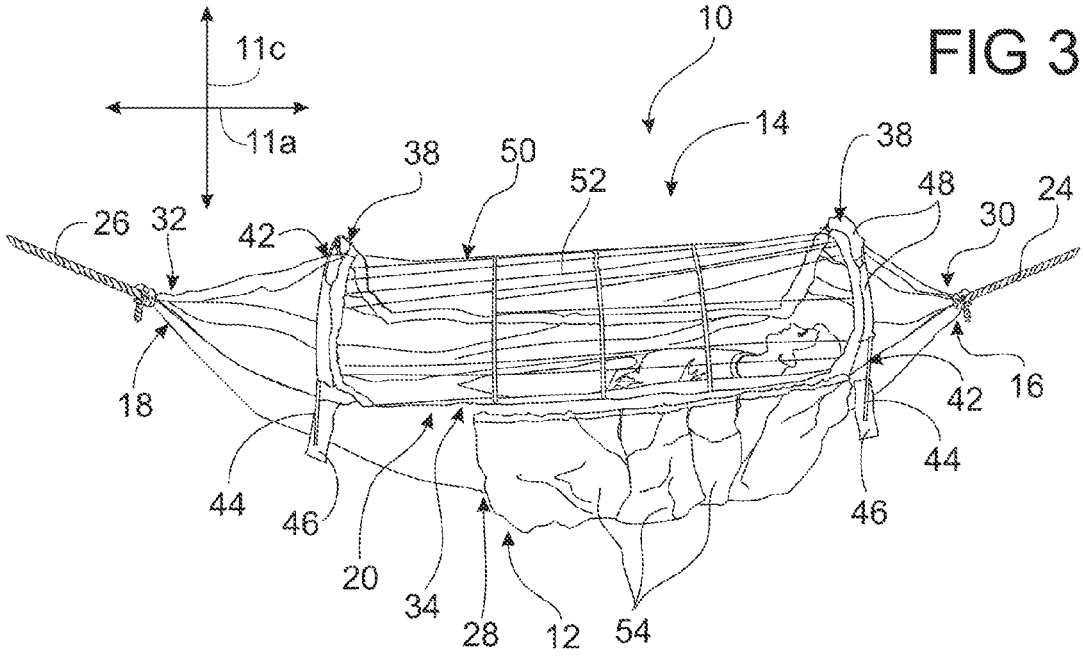
FIG. 3 is a side perspective view of a hammock in accordance with the present invention in an occupied configuration.
Figure 4:
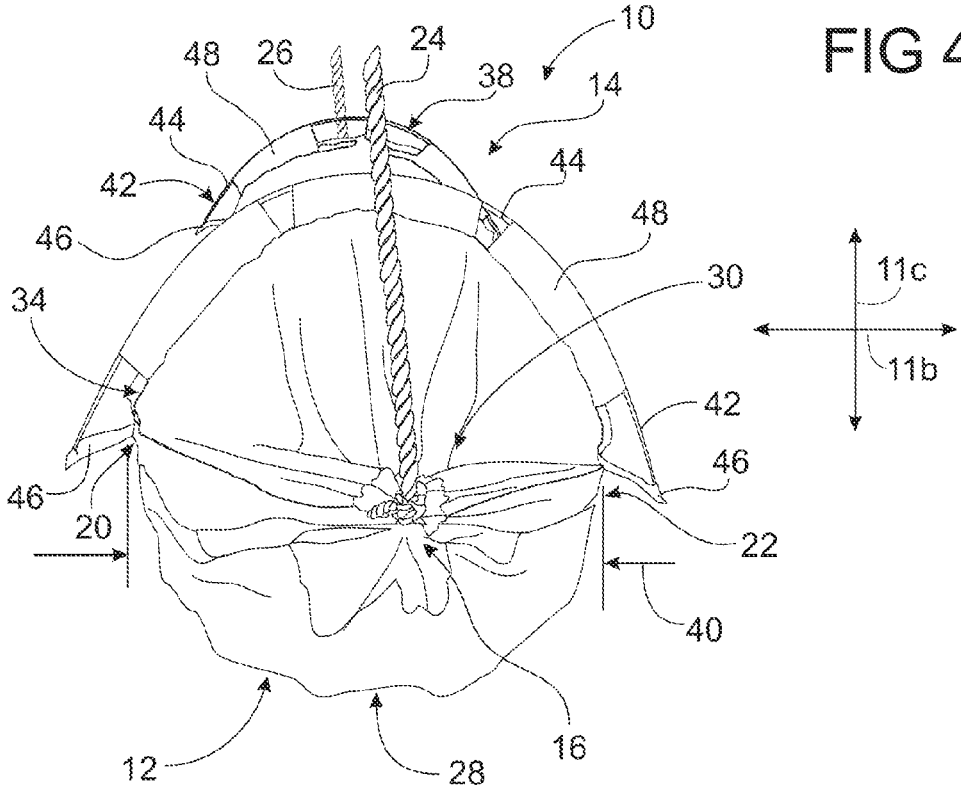
FIG. 4 is an end perspective view of the hammock of FIG. 3.

This concept of an optimized spreader 42 may become more evident when comparing FIG. 1 to FIG. 3. The hammock 10 illustrated in these two figures is the same. The only difference is that in FIG. 1, the hammock 10 is unoccupied and substantially unweighted by contents, while in FIG. 3, the hammock 10 is occupied by a user. The spreaders 42 applied to the hammock 10 in these figures are optimized for the occupied configuration (i.e., the configuration show in FIG. 3).

As can be seen, in FIG. 3, the entryway portion 50 of the hammock canopy 14 is ideally tensioned. The occupant in hammock 10 would not feel that the hammock canopy 14 is sagging and encroaching on him. In contrast, in FIG. 1, the entryway portion 50 of the hammock canopy 14 sags into the interior of the enclosure formed by the hammock 10. However, in the unoccupied and substantially unweighted configuration of FIG. 1, there is by definition no occupant being encroached by such sagging. Moreover, the amount of spreading 40 imposed and the suspension of the hammock canopy 14 is sufficient to fully expose the entryway 50 to view so that it may easily be opened or closed.

In selected embodiments, the amount of sag in a hammock canopy 14 may be used as an indicator of proper hammock 10 installation. That is, when suspending a hammock 10 between anchors, an installer may refer to the amount of sag in a hammock canopy 14 rather than resorting to a trial and error method requiring repeated entering and exiting of the hammock 10.

In such a method in accordance with the present invention, an installer may suspend a hammock 10 between two anchors, then install one or more spreaders 42. Once the spreaders 42 are installed, the installer may view the sag in the hammock canopy 14. If the sag is excessive, the installer may shorten the tethers 24, 26 suspending the hammock 10. This may raise the hammock 110 and reduce the sag in the hammock canopy 14. If the sag is too little, the installer may lengthen the tethers 24, 26 suspending the hammock 10. This may lower the hammock 110 and increase the sag in the hammock canopy 14.

Once the sag of the hammock canopy 14 is at the appropriate level, the installer may be assured that when occupied, the dynamic spreading system 38 will impose just the right spread 40 (and corresponding arch height) to optimally tension the hammock canopy 14 once the hammock 10 is weighted or occupied. In selected embodiments, the sag of the hammock canopy 14 in FIG. 1 may be this appropriate level. In such embodiments, the sag may be about one half the maximum height of the hammock canopy 14 above a corresponding hammock base 12.

Figure 5:
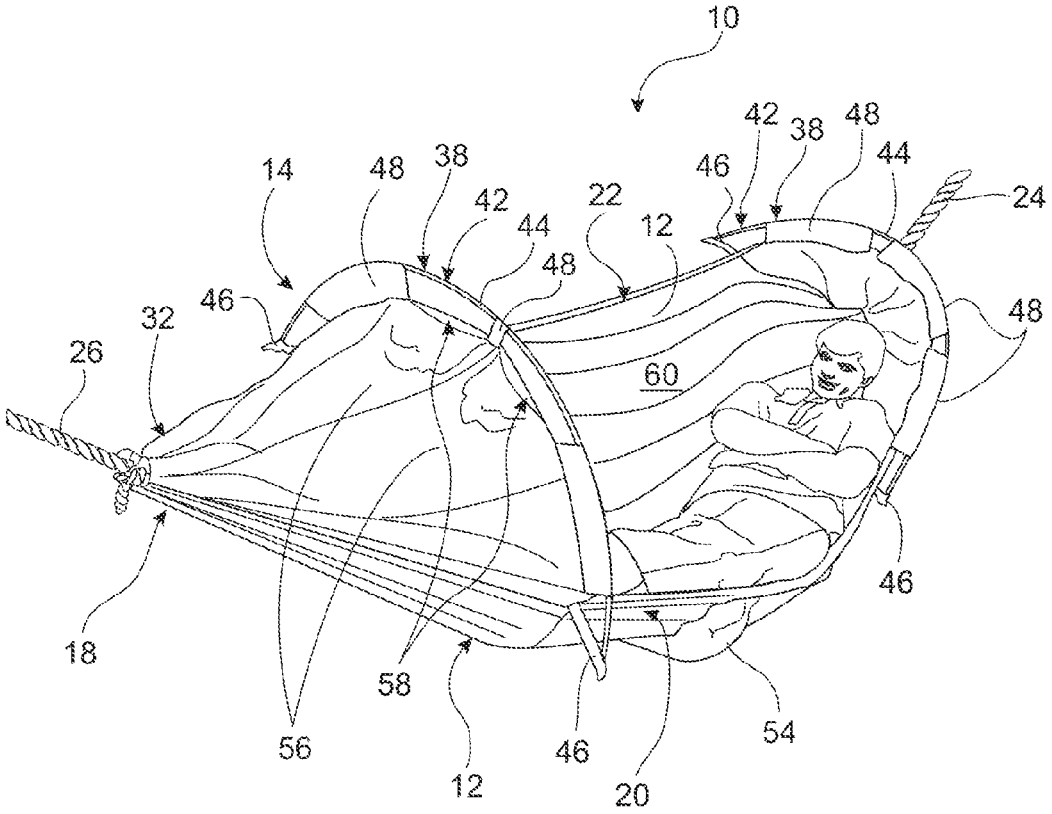
FIG. 5 is a perspective view of a hammock in an occupied configuration with the hammock canopy open and the occupant positioned eccentrically with respect to the hammock base and spreader system.

Referring to FIG. 5, in selected embodiments, a hammock 10 may include one or more pockets 56 for receiving and storing the door 50 or entryway 50 portion of the hammock canopy 14 when it is not in use. Such pockets 56 may include openings 58 into which the door 50 or entryway 50 may be tucked.

In certain embodiments, a portion of a hammock canopy 14 may include two pockets 56. Each pocket 56 may have an opening 58 corresponding thereto. One such pocket 56 may be configured to receive and store the wind-break layer of the entryway 50 when it is not in use. The other such pocket may be configured to receive and store the netting 52 layer of the entryway 50 when it is not in use.

A hammock 10 in accordance with the present invention may provide certain advantages associated with hammocks having rigid spreaders. However, due the dynamic nature of such a spreader system 38, a hammock 10 in accordance with the present invention may avoid the instability associated with hammocks having rigid spreaders.

For example, hammocks having rigid spreaders are held open and are therefore relatively easy to enter. Also, due to their open nature, hammocks having rigid spreaders may seem non-confining, inviting, and comfortable. However, these advantages come at a cost. Hammocks having rigid spreaders are inherently unstable. If the weight carried by a hammocks having rigid spreaders is insufficiently centered with respect to those spreaders, that weight will be dumped from the hammock. In contrast, a hammock 10 in accordance with the present invention may provide an open, inviting, non-confining environment that is both easy to enter and stable.

An occupant may be eccentrically positioned with respect to a hammock base 12 and a dynamic spreader system 38 without destabilizing a hammock 10 in accordance with the present invention. In the past, such stability was the exclusive domain of spreaderless hammocks. However, unlike in typical spreaderless hammocks, an occupant of a hammock 10 in accordance with the present invention is not enveloped or cocooned in material. Rather, the occupant may enjoy a rather spacious and open environment in which the unoccupied portion 60 of the hammock base 12 is held up and away from the occupant.

Figure 6A:
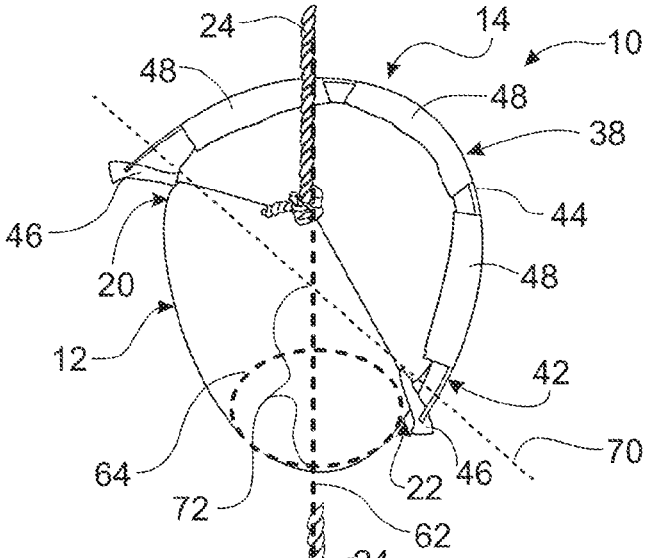
FIG. 6A is an end elevation view of a hammock in accordance with the present invention with the occupant or contents eccentrically positioned proximate the second side of the hammock base.
Figure 6B:
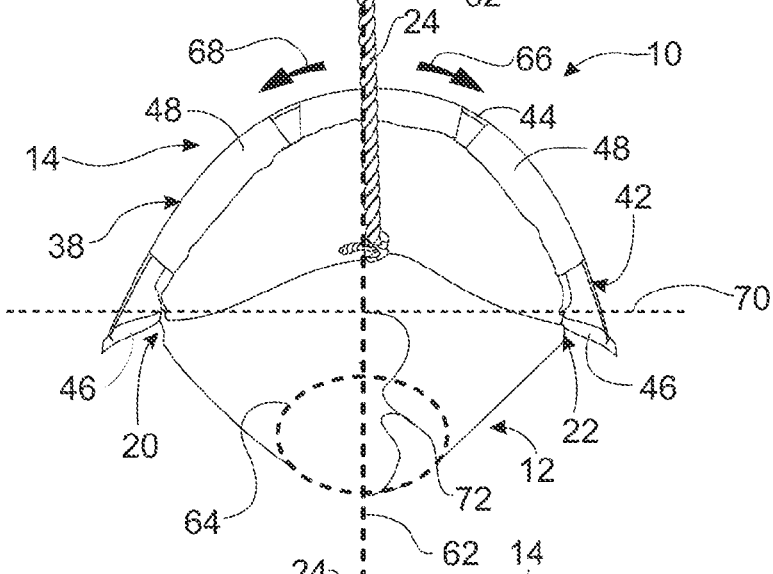
FIG. 6B is an end elevation view of a hammock in accordance with the present invention with the occupant or contents centrally positioned with respect to the hammock base and spreader system.
Figure 6C:
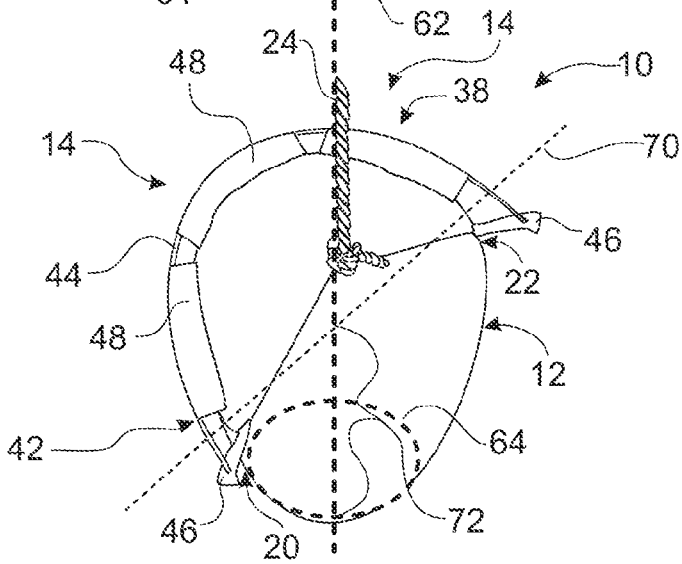
FIG. 6C is an end elevation view of a hammock in accordance with the present invention with the occupant or contents eccentrically positioned proximate the first side of the hammock base.

Referring to FIGS. 6A, 6B, and 6C, in selected embodiments, a hammock 10 in accordance with the present invention may align its center of mass with a vertical plane 62 containing the tethers 24, 26 extending from opposite ends of the hammock 10. As contents are added to such a hammock 10, the combined center of mass of the contents and the hammock 10 may also align with the same vertical plane 62.

Due to the large difference between the mass of an occupant 64 and the mass of the hammock 10, the center of mass of the occupant 64 may largely define the center of mass of the hammock 10 and occupant 64 system. Accordingly, as an occupant 64 moves within the hammock base 12, he or she may not leave the vertical plane 62. The hammock 10, on the other hand, may effectively rotate around or about the occupant 64.

For example, as an occupant moves (e.g., rolls) toward the second side 22 of the hammock base 12, the hammock 10 may effectively rotate in a first direction about the occupant 64. Conversely, as an occupant moves toward the first side 20 of the hammock base 12, the hammock 10 may effectively rotate in a second direction 68, opposite the first direction 66, about the occupant 64.

As an occupant 64 moves through the range of motion supported by the hammock base 12, from one extreme (e.g., the position shown in FIG. 6A) to the other (e.g., the position shown in FIG. 6C), the occupant 64 may enjoy at all times an open area thereabove. Accordingly, a hammock 10 in accordance with the present invention may provide an open, inviting, non-confining environment.

Similarly, as an occupant 64 moves through the range of motion supported by the hammock base 12, the occupant 64 may enjoy at all times a stable platform. That is, at no point in the range of motion supported by the hammock base 12 is the occupant 64 pushed or urged toward further motion. The occupant 64 may reside just as stably in an extreme of the range of motion as the occupant 64 can in the center of the range of motion.

In selected embodiments, the stability of a hammock 10 in accordance with the present invention may arise at least in part by the inability of the dynamic spreader system 38 to laterally flatten the hammock base 12. A dynamic spreader system 38 may urge separation of the first and second sides 20, 22 of the hammock base 12 in the lateral direction 11*b*. However, a dynamic spreader system 38 may not have unlimited strength or force to urge that separation. In certain embodiments, a spreader 42 of a dynamic spreader system 38 may be configured (e.g., sized) with insufficient strength or force to laterally flatten an unweighted hammock base 12, let alone an occupied one.

That is, one may imagine a line 70 extending laterally from one side 20 of a hammock base 12 to the other 22. In selected embodiments, this line 70 may pass through the locations where the extension straps 46 secure to the hammock 10. Accordingly, the line 70 may approximate a line at which a spreader 42 applies its spreading force to a hammock base 12.

The distance 72 between this imaginary line 70 and the bottom of the hammock base 12 may reflect the ratio between the spreading force of a spreader 42 and the weight of a hammock 10 and its contents. The greater the spreading force of a spreader 42 in comparison to the weight of a hammock 10 and its contents, the less the distance 72. Conversely, the lower the spreading force of a spreader 42 in comparison to the weight of a hammock 10 and its contents, the greater the distance 72.

If a dynamic spreader system 38 in accordance with the present invention were removed and replaced by a typical rigid spreader in the typical manner, then the distance 72 between the imaginary line 70 and the bottom of the hammock base 12 would be minimal. Accordingly, there would be no sagging pocket in the hammock base 12 to support an occupant 64. There would be no inherent stability. Once movement of an occupant 64 induced excessive rotation 66, 68, there would be nothing to stop it, with the result being the dumping of the occupant 64 from the hammock base 12.

Accordingly, to overcome the problems associated with rigid spreaders, a spreader 42 of a dynamic spreader system 38 in accordance with the present invention may be configured with insufficient strength or force to laterally flatten an occupied hammock 10. By so doing, the hammock base 12 may provide stable support for an occupant 64 in the extreme positions illustrated in FIGS. 6A and 6C.

Figure 7:
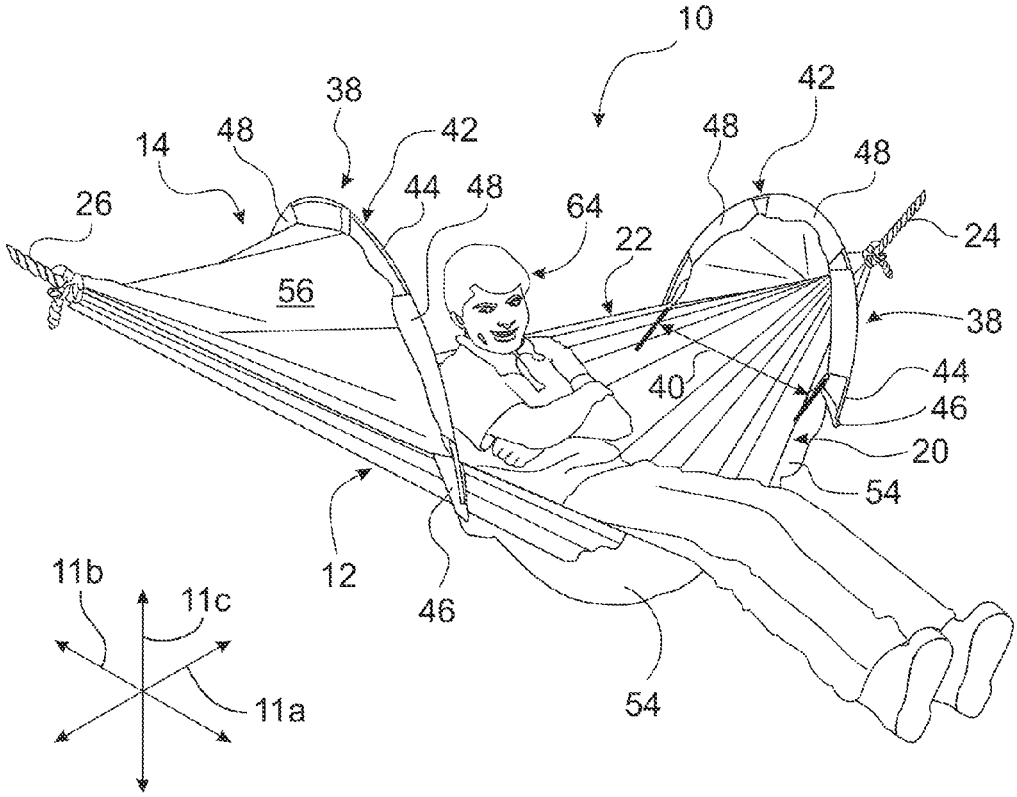
FIG. 7 is a perspective view of a hammock in an occupied configuration with the hammock canopy open and the occupant positioned orthogonally with respect to the longitudinal axis of the hammock.

Referring to FIG. 7, a dynamic spreader system 38 in accordance with the present invention may support a wide range of spreading 40. The amount of spreading 40 imposed may depend on various factors as discussed hereinabove. In selected embodiments, the greatest spreading 40 may correspond to an unoccupied or substantially unweighted hammock 10. The minimum spreading 40 may be about zero. That is, the first and second sides 20, 22 of a hammock base 12 may be drawn substantially together without failing the dynamic spreader system 38.

In actual use, the minimum spreading 40 may correspond to a hammock base 12 being used as a seat or chair, with the occupant 64 oriented orthogonally with respect to the longitudinal direction 11*a*. When used in that manner, a large portion of the lateral width of the hammock base 12 may be loaded by the weight of the occupant 64. Accordingly, substantially all of the hammock base 12 may be tensioned in the longitudinal direction 11*a*.

Due to the configuration of the spreaders 42, the dynamic spreader system 38 may have insufficient strength or force to laterally spread such a tensioned hammock base 12. Accordingly, the spreaders 42 may simply adapt to or reflect the amount of spreading 40 between the first and second sides 20, 22 of the hammock base 12 imposed by the particular use.

Figure 8:
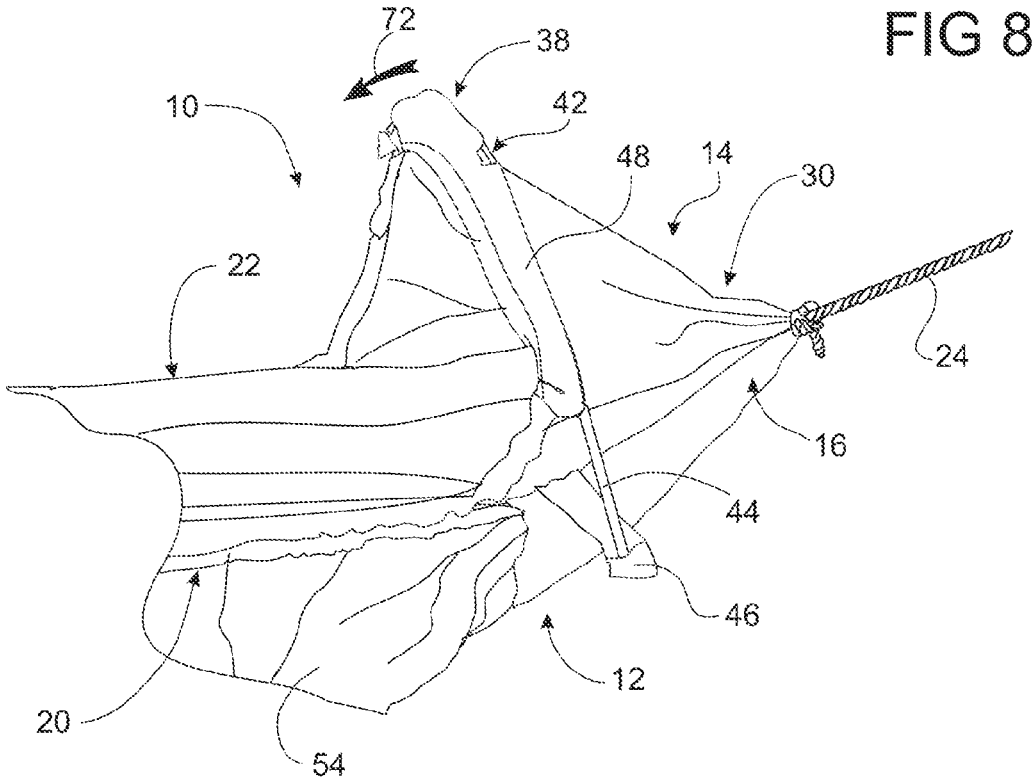
FIG. 8 is a partial perspective view of one end of a hammock with the hammock canopy open and a spreader in accordance with the present invention oriented vertically in its base or home position.
Figure 9:
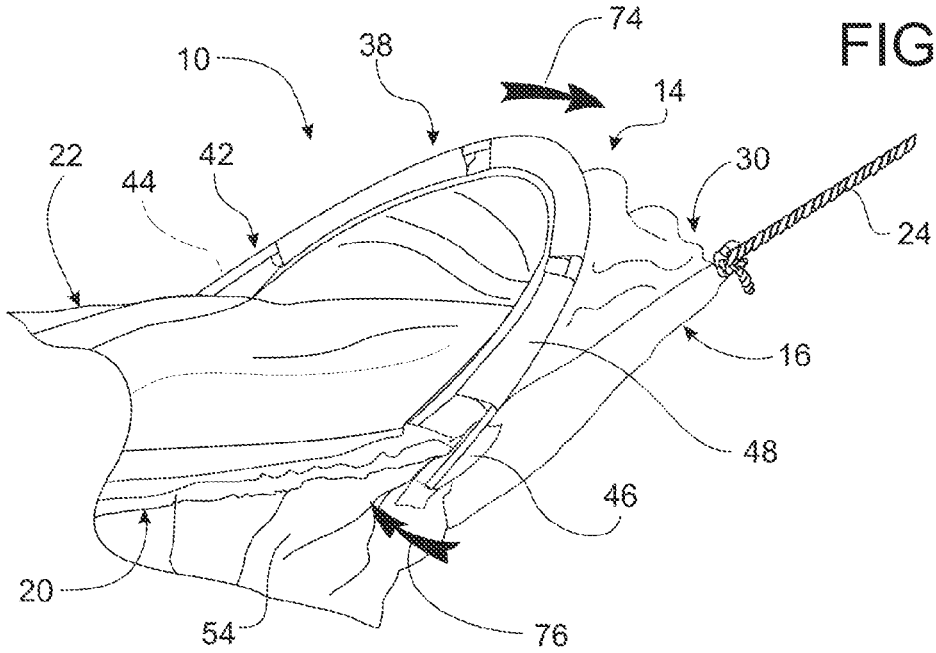
FIG. 9 is a partial perspective view of one end of a hammock with the hammock canopy open and a spreader in accordance with the present invention pushed or deflected out of its base or home position.

Referring to FIGS. 8 and 9, in selected embodiments, a spreader 42 in accordance with the present invention may be biased toward a vertical orientation. For example, the arch formed by a spreader 42 when it is deflected over a hammock base 12 may be biased toward a vertical position. So configured, a spreader 42 may maintain a substantially vertical orientation, even when the entryway 50 in the hammock canopy 14 is open.

That is, when a spreader 42 is in a vertical position and the entryway 50 of the hammock canopy 14 is open, material forming the hammock canopy 14 may resist leaning 72 of the arch toward the longitudinal center of the hammock 10. However, when the entryway 50 in the hammock canopy 14 is open, no portion of the hammock canopy 14 may be available to resist leaning 74 of the arch toward the other side (i.e., away from the longitudinal center of the hammock 10). In such situations, the bias of the spreader 42 may be sufficient to maintain the spreader 42 in the vertical position.

In selected embodiments, the bias of a spreader 42 toward the vertical position may arise due to the lower energy associated with that position. For example, as the arch of a spreader 42 is pushed 74 away from the longitudinal center of the hammock 10, the material of the hammock canopy 14 (e.g., the sleeves 48, contour or perimeter shape of the entryway 50, etc.) may act in concert with the extension straps 46 to increase the load or deflection applied to the spreader 42. In certain embodiments, this increased load or deflection may cause the ends of the spreader 42 to deflect 76 closer in toward the hammock base 12. Due to the increase in the load or deflection applied to a spreader 42 in a non-vertical position, the spreader 42 may urge (e.g., with an equal and opposite force) a return to the vertical position.

Figure 10:
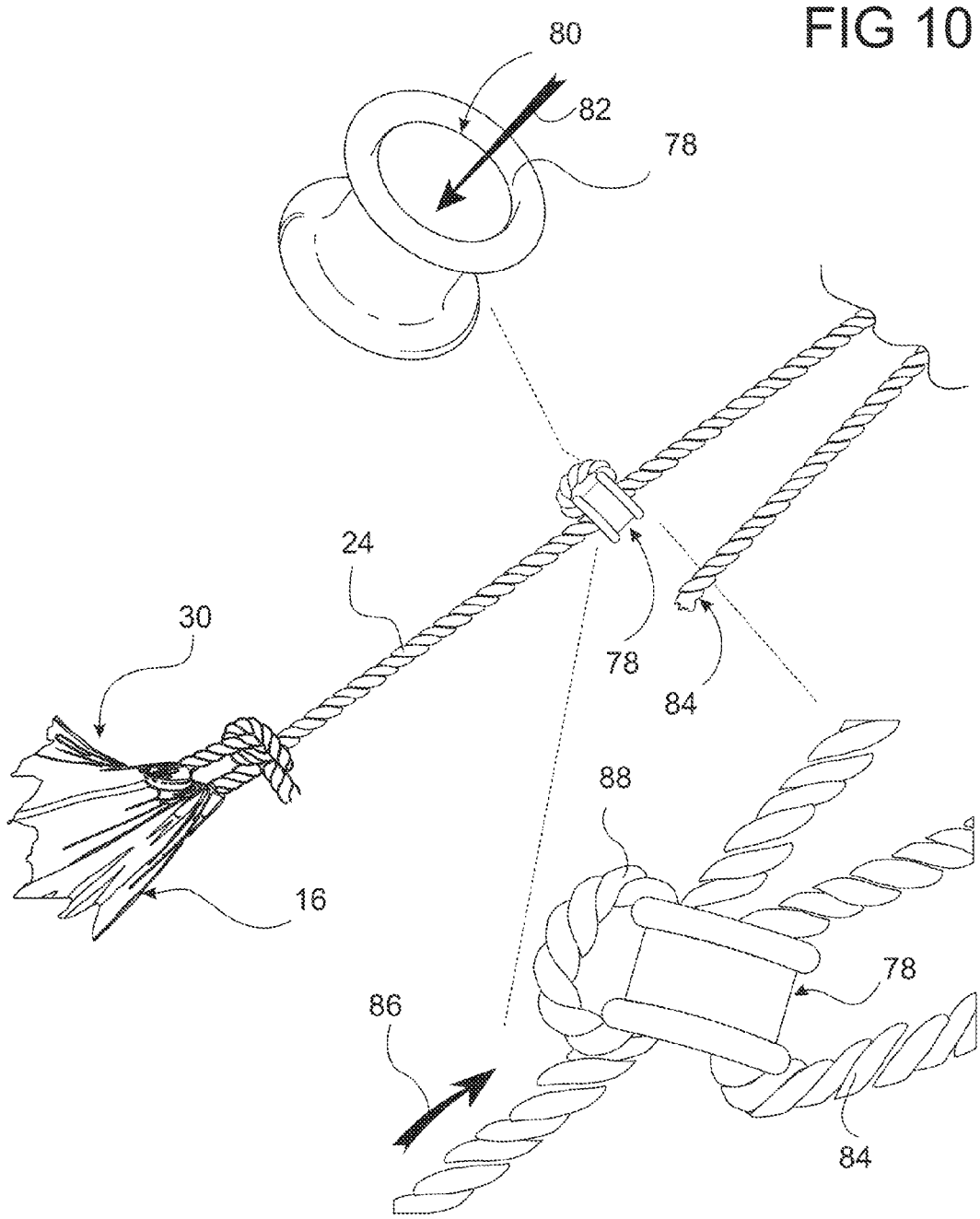
FIG. 10 is a partial perspective view illustrating a drip ring adjustment apparatus and method in accordance with the present invention.

Referring to FIG. 10, in certain embodiments, it may be desirable to adjust the length of a tether 24, 26 suspending a hammock 10. This may be done by untying then retying a tether 24, 26, pulling a tether 24, 26 through an adjustment buckle, or the like. Additionally, in selected embodiments in accordance with the present invention, a drip ring adjustment method may be used to adjust the length of a tether 24, 26.

A drip ring 78 may prevent water from running down a tether 24, 26 and wetting a hammock 10. In an installed configuration, a tether 24, 26 may pass through the interior aperture 80 of the drip ring 78 in a first direction 82, wrap around one side of the ring 78, then again pass through the interior aperture 80 in the first direction 82. When the tether 24, 26 is tensioned (e.g., the hammock 10 is weighted), the drip ring 78 may be held securely in place. Due to this securement, the drip ring 78 may provide a location to which a free end 84 of the tether 24, 26 may secure.

That is, the free end 84 of a tether 24, 26 may extend away from a hammock 10, engage an anchor, then return back along itself. As it returns along itself, the free end 84 may engage or be tied to the drip ring 78, thus defining the effective length of the tether 24, 26. In such embodiments, the effective length of the tether 24, 26 may be adjusted by moving the drip ring 78 toward or away from the hammock 10.

This may be accomplished by first removing the tension in the tether 24, 26 (e.g., removing objects of significant weight from the hammock 10). Material forming the tether 24, 26 may then be inserted 86 though the aperture 80 in the drip ring 78 to enlarge and loosen the loop 88 wrapped around the side of the drip ring 78. With the loop 88 enlarged and loose, the drip ring 78 may advance or retreat along the tether 24, 26 until the desired new effective length is reached. When the desired effective length for the tether 24, 26 is reached, the loop 88 may be pulled tight against the drip ring 78, thereby locking it in place.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A hammock suspended between two anchors, the hammock comprising:

a hammock base defining longitudinal and lateral directions;

a first flexible member deflected to overarch the hammock base;

the hammock base sagging below the first flexible member with slack in the lateral direction; and the first flexible member applying a force to the hammock base, the force urging lateral spreading of the hammock base, the force being insufficient to remove the slack below the first flexible member.

2. The hammock of claim 1, further comprising a second flexible member deflected to overarch the hammock base.

3. The hammock of claim 2, wherein the hammock base sags below the second flexible member with slack in the lateral direction.

4. The hammock of claim 3, wherein the second flexible member urges lateral separation of the hammock base with a force insufficient to remove the slack therebelow.

5. The hammock of claim 4, further comprising a hammock canopy cooperating with the base to form an enclosure.

6. The hammock of claim 5, wherein the first and second flexible members suspend the hammock canopy above the hammock base.

7. The hammock of claim 1, further comprising a hammock canopy cooperating with the base to form an enclosure.

8. The hammock of claim 7, wherein the first flexible members suspends at least a portion of the hammock canopy above the hammock base.

9. The hammock of claim 1, wherein the first flexible member has a substantially linear neutral, non-deflected configuration.

10. The hammock of claim 1, wherein the first flexible member is a collapsible elongated member comprising multiple segments selectively connected by at least one coupler.

11. A hammock system comprising:

one or two flexible members comprising the only lateral spreaders forming part of the hammock system;

a hammock comprising a hammock base, and one or two engagement systems for engaging and retaining the one or two flexible members; and the one or two flexible members each comprising a collapsible elongated member comprising multiple segments selectively connected by at least one coupler.

12. The hammock system of claim 11, wherein the hammock further comprises a hammock canopy cooperating with the hammock base to form an enclosure.

13. The hammock system of claim 12, wherein the one or two engagement systems each comprise first and second extension straps for engaging and retainer first and second ends of a corresponding flexible member of the one or two flexible members.

14. The hammock system of claim 13, wherein the one or two engagement systems each further comprise one or more sleeves or hooks for suspending a corresponding portion of the hammock canopy from a corresponding flexible member of the one or two flexible members.

15. A hammock suspended between two anchors, the hammock comprising:

a hammock base defining longitudinal and lateral directions;

a hammock canopy cooperating with the hammock base to form an enclosure;

the hammock canopy comprising a first end portion, a second end portion, and a door located longitudinally between the first and second end portions;

a first flexible member deflected to overarch the hammock base and suspend the first end portion above the hammock base; and the first flexible member having a resiliency that both urges lateral spreading of the hammock base and biases the first flexible member toward a vertical orientation without regard to whether the door is fully open, partially open, or fully closed.

16. The hammock of claim 15, wherein the hammock base sags below the first flexible member with slack in a lateral direction.

17. The hammock of claim 16, wherein the first flexible member urges lateral spreading of the hammock base with a force insufficient to remove the slack therebelow.

18. The hammock of claim 17, wherein the door comprises substantially all of the hammock canopy located between the first and second end portions.

19. The hammock of claim 18, further comprising a second flexible member deflected to overarch the hammock base and suspend the second end portion above the hammock base.

20. The hammock of claim 19, wherein the second flexible member has a resiliency that both urges lateral spreading of the hammock base and biases the second flexible member toward a vertical orientation when the door is fully open, partially open, or fully closed.

* * * * *